US009320954B1

(12) United States Patent
Simpkins

(10) Patent No.: US 9,320,954 B1
(45) Date of Patent: Apr. 26, 2016

(54) REFLEX STRIKE TECHNOLOGY

(71) Applicant: Jermaine Simpkins, North Las Vegas, NV (US)

(72) Inventor: Jermaine Simpkins, North Las Vegas, NV (US)

(73) Assignee: Jermaine Simpkins, North Las Vegas, NV (US)

( * ) Notice: Subject to any disclaimer, the term of this patent is extended or adjusted under 35 U.S.C. 154(b) by 0 days.

(21) Appl. No.: 13/998,956

(22) Filed: Feb. 26, 2014

Related U.S. Application Data

(60) Provisional application No. 61/849,205, filed on Jan. 23, 2013.

(51) Int. Cl.
*A63B 24/00* (2006.01)
*A63B 69/00* (2006.01)

(52) U.S. Cl.
CPC ..... *A63B 69/004* (2013.01); *A63B 2220/53* (2013.01); *A63B 2220/62* (2013.01); *A63B 2220/64* (2013.01)

(58) Field of Classification Search
CPC .. A63B 24/00; A63B 24/0062; A63B 69/004; A63B 2220/53; A63B 2220/62; A63B 2220/64
USPC ..... 482/83–90
See application file for complete search history.

(56) References Cited

U.S. PATENT DOCUMENTS

| | | | | |
|---|---|---|---|---|
| 3,896,497 | A | 7/1975 | Rhee | |
| 4,883,271 | A * | 11/1989 | French | 273/454 |
| 4,974,833 | A * | 12/1990 | Hartman et al. | 482/3 |
| 5,553,860 | A * | 9/1996 | Zelikovich | 473/455 |
| 5,723,786 | A | 3/1998 | Klapman | |
| 5,741,970 | A | 4/1998 | Rubin | |
| 6,280,351 | B1 * | 8/2001 | Wong | 473/422 |
| 6,544,099 | B2 * | 4/2003 | Shafik | 446/404 |
| 6,925,851 | B2 | 8/2005 | Reinbold | |
| 7,308,818 | B2 * | 12/2007 | Considine et al. | 73/12.09 |
| 8,011,222 | B2 | 9/2011 | Wiber | |
| 2009/0176632 | A1 * | 7/2009 | Wiber | 482/84 |

* cited by examiner

*Primary Examiner* — Glenn Richman

(57) ABSTRACT

A martial arts and combat sports training advantage comprised of using traditional shaped training striking pads worn or held by a combat sports trainers, as disclosed in previous patents, and equipping the striking pads with trainer triggered adjustably timed lights designed to stimulate reflexes and allow the trainer to give non-verbal striking orders to the person being trained. Vibration sensors detect the strike, transmitting the strike to an internal microchip which allow for the characteristics of the strike to be shown on the digital number display.

4 Claims, 6 Drawing Sheets

REFLEX STRIKE TECHNOLOGY

CROSS REFERENCE TO RELATED APPLICATIONS

The present application is a continuation of U.S. patent application 61/849,205 and has at least one same inventor of the present application and is herein incorporated by this reference.

BACKGROUND OF THE INVENTION

1. Field of the Invention

The present invention relates to improvements of traditional striking pads worn or held by a trainer of combat sports include: Body pads (worn around the body), focus mitts (worn on the hand), kick shields (hand held) and individual targets (hand held) and previous inventions which monitor striking effectiveness which are not traditionally shaped trainer held or worn strike pads.

Traditionally, striking pads have been the main tool for trainers of many striking disciplines. Striking pads come in various shapes and functions and are worn or held by a trainer. Some striking pads are worn or held on the hand and some striking pads are worn on the body, but they all share the perk of allowing mobile training. The purpose of striking pads is to train striking by positioning pads in key locations on said trainer's body that simulate striking key locations on an opponent as well as facilitate striking mobility as the trainer becomes the mobile target. The importance of striking pads is that they simulate sparring by allowing a fighter to train strikes without actually hitting another person. The trainer will hold or wear striking pads in various locations during a training session, which allow the fighter to simulate strikes to the body and head of an opponent without actually hitting another person directly.

2. Description of Related Art

In U.S. Pat. No. 3,896,497, Rhee discloses an energy absorbing device for use with a person's hand to protect the hand during training and contests in various sports such as karate, boxing, etc. The device is constructed of resilient foam means covered with a tough, pliable surface coating. The device generally comprises a pair of spaced, parallel, resilient members suitably secured together with a space there between. The device is adapted to permit insertion of the hand into the space between the two resilient members.

Rhee sets the foundation for the traditional striking pad in his invention. While the hand is entered into the striking pad and worn by a trainer, it does not use trainer triggered lights to direct orders for the person being trained to strike.

The presented invention here fills the void set forth by Rhee by allowing the trainer to activate the commands to strike by triggering the switch for the light. Unlike the Rhee invention, the present invention allows the trainer to give commands to strike at the speed of light. No time is lost with the present invention as the person being trained does not need to relate the verbal or physical cue to strike. With the present invention, the person being trained is stimulated by the light and simply reacts without verbal cues, more similar to a real fight scenario.

U.S. Pat. No. 3,933,354 to Goldfarb et al. discloses a reflex testing amusement apparatus that allows simulated head-to-head sparring and scoring. The picture of each combatant camouflages a series of lights, with each light being located at a key attack/defense point on the combatant's body. At the start, one of the lights is turned on and the participants each try to hit their light to turn it off. The first "hit" causes both first lights to extinguish and a second light in each series to illuminate. The player to make the first "hit" gets a scoring credit for that "hit." The participants strike at the second light and so on as the lights are sequenced in a pseudo-random order. The game continues for a predetermined period and at the end a winner is determined by comparing the number of "hits" made by the players. Modifications for a single-player game and a game which runs until a predetermined score is made are also provided.

Unlike U.S. Pat. No. 3,933,354 from Goldfarb, the present patent trains and test reflexes using trainer triggered lights that are not automated or programmed. In addition, U.S. Pat. No. 3,933,354 is a game while the present patent is used within traditional striking pads worn or held by a trainer for the purpose of maximizing the reflexes of combat sports athletes.

In U.S. Pat. application 20090264263, Yang discloses an invention for a trainer held strike padding in the shape of a human torso. The torso described in the Yang invention illustrates a human like torso that may be used to transmit the effectiveness of strikes in key locations of the humanlike strike pad. It should be noted that Yang's portable strike pad does not incorporate lights.

The present invention incorporates the use of traditional shaped training pads that are worn or held by trainers and infuses them with lights triggered by the trainer. Unlike the Yang invention, explaining the difference of the previous invention being the humanlike shape, the present invention introduces new technology to assess striking effectiveness within the striking pads through traditional shapes of trainer held or worn pads with proven public acceptability.

U.S. Pat. application 20040220021, Bryant discloses a martial arts practice apparatus which is comprised of a punching and kicking pad secured by spring loaded connectors to a board to which is also attached a timing light that blinks intermittently at irregular intervals. The board is rigidly connected to a wall. The user of the apparatus practices punching and or kicking the pad each time and as soon as the timing light blinks on. Such practice improves the user's martial arts punching and kicking reflexes. The punching and kicking pad may also be used without the timing light being turned on.

While Bryant uses light stimulation in his invention, he removes the trainer from the training regime of training a fighter's reflexes. The present patent uses trainer triggered lights instead of programmed lights as Bryant. Bryant also uses a wall mounted striking pad; the present invention uses trainer worn or held striking pads in the traditional shape.

BRIEF SUMMARY OF THE INVENTION

The present invention adds another aspect to traditional shaped training pads worn or held by trainers. With the addition of the timed light stimulation the present invention discloses, fighters and trainers now can gauge and train reflexes with a mobile trainer. The present invention still allows for use as traditional shaped striking pads worn or held by trainers as disclosed in previous inventions but adds the trainer benefits not mentioned in previous inventions pertaining to trainer held or worn training pads in the traditional shape. Adding controls to the thumb area of the striking pad and a light for visual stimulation, the present invention allows the trainer to pinpoint the exact moment for the fighter to strike. In normal striking pads worn by the trainer, the fighter must be given either physical or verbal directives to strike; in more rare instances, orders to strike a target have been automated using programmed patterns of light. The present invention gives the trainer the control to trigger the light, adjust the duration of the light and make striking adjustments to the person being trained. The successful strike beep allows for real-time changes to be made on the spot as the trainer and the person being trained can hear a beep sound if the target area of the pad is hit before the light goes off.

The present patent provides successful strike affirmation. Using the successful strike beep, both trainer and fighter know that the fighter responded on time. This allows for adjustments to be made in either the fighter or adjustments can be made in the amount of time the light is on. Changes in stance and body position can be made in real-time which allow for constant corrections needed to respond in the ideal striking time.

Unlike normal training pads worn by trainers, the present invention has lights. It should be made clear that this invention is the first of its kind to incorporate lights on training pads worn by trainers (not to be confused with lights on punching bags, wall mounted or hanging strike targets). With the present invention, the lights are not automated or programmed; they are activated by the trainer, which gives the trainer more control over the training session. The trainer's creativity and randomness with the lights forces fighters to always stay in position to strike. With normal training pads, fighters can get away with not staying in position because, unlike the present invention, there will not be any random lights activated by the trainer without warning. Because of the spontaneity of the lights, fighters will train their striking reflexes as well as learn to always be in position to strike. While automated light stimulation has been used in previous inventions, mobile targets used by trainers provide better strike training advantages as real combat rarely competes in a stationary position. The duration of the light time is also essential to honing ones reflexes and striking position as shorter light spans require faster reaction time.

The present invention introduces the idea of trainer triggered light on traditional shape striking pads worn or held by trainers. The combination of the trainer triggered lights, electronic components and the use of traditional strike pads worn or held by trainers is what make the present invention unique.

It should be noted that the present invention not only seeks to train a fighter's response to the light but also seeks to display various categories of striking effectiveness depending on which model is constructed amongst the variation of traditional shaped striking pads either worn or held by trainers. While there are other products that read striking power, speed and possible reaction time, the present invention performs these measurements using striking pads worn or held by the trainer in their traditional shape. Previous ideas have used these measurements on actual punching (boxing) gloves worn by the fighter, punching bags and machines constructed with mechanical strike areas; the present invention is unique as it empowers the trainer by applying technology to traditional shape strike pads worn or held by trainers and gives the trainer control to activate the light and toggle through the settings. The present invention incorporates technology into trainer worn or held equipment which should be seen as separate from stationary strike targets or technology added to the fighter's gloves.

BRIEF DESCRIPTION OF DRAWINGS

The drawings presented shows how traditional striking pads worn or held by a trainer can incorporate trainer triggered lights and display meters to show striking performance in various categories.

DETAILED DESCRIPTION OF THE PREFERRED EMBODIMENTS OF THE DRAWINGS

Figure 1:
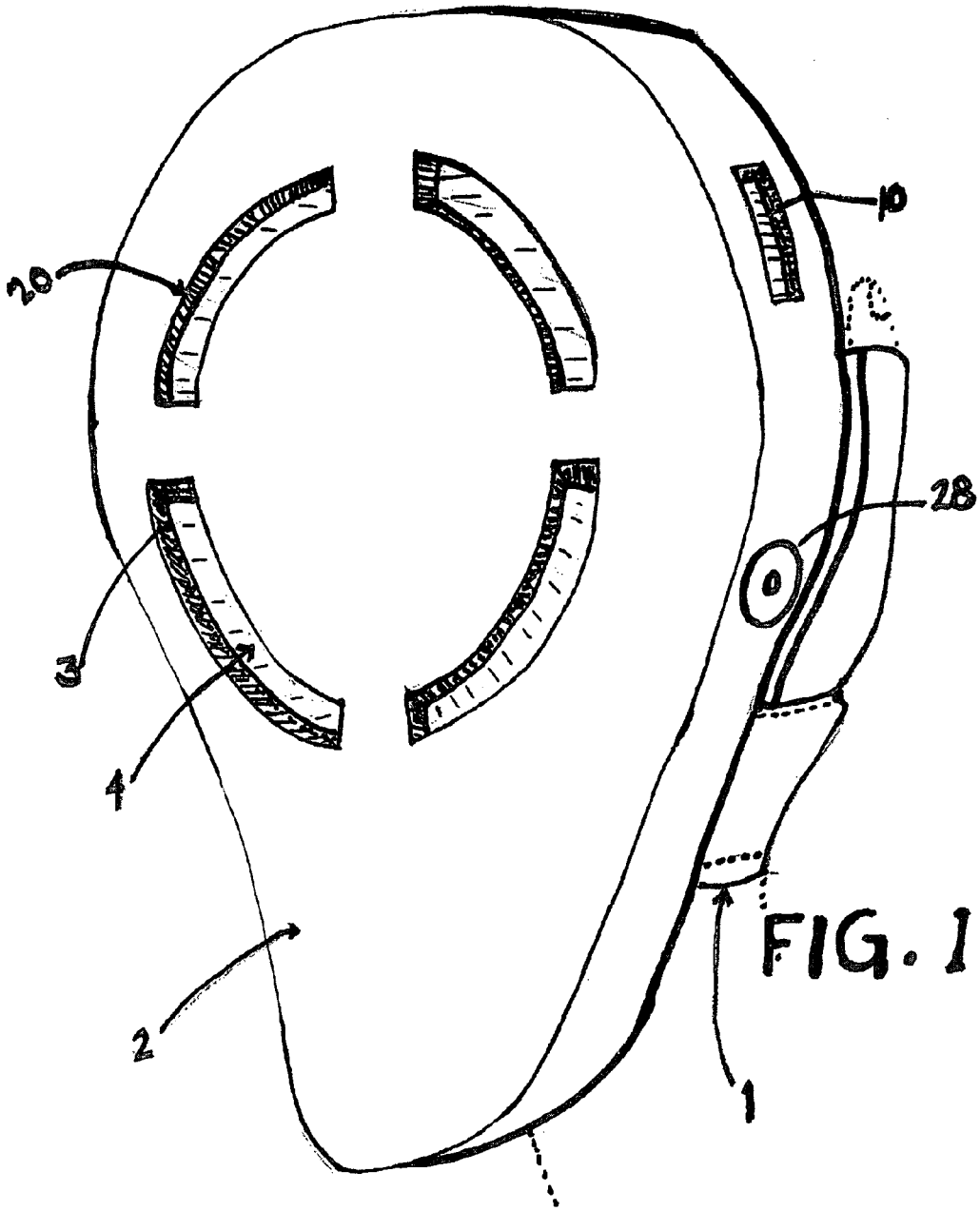
FIG. 1 shows the face view of a traditional hand worn striking pad equipped with Reflex Strike Technology.

FIG. 1 illustrates a traditional striking pad worn on the hands of a trainer similar to U.S. Pat. No. 3,896,497 by Rhee. The present patent illustration shows a striking area of a striking pad 2, a target cut out on the striking area padding 3 which is where the light 4 is inserted. The trainer's hand is inserted into the glove 1 on the opposite side of the striking area. Clear vinyl 20 allows for the thin lights to be seen through the strike area of the pad without being exposed to damage from strikes as shown in FIG. 4.

Figure 2:
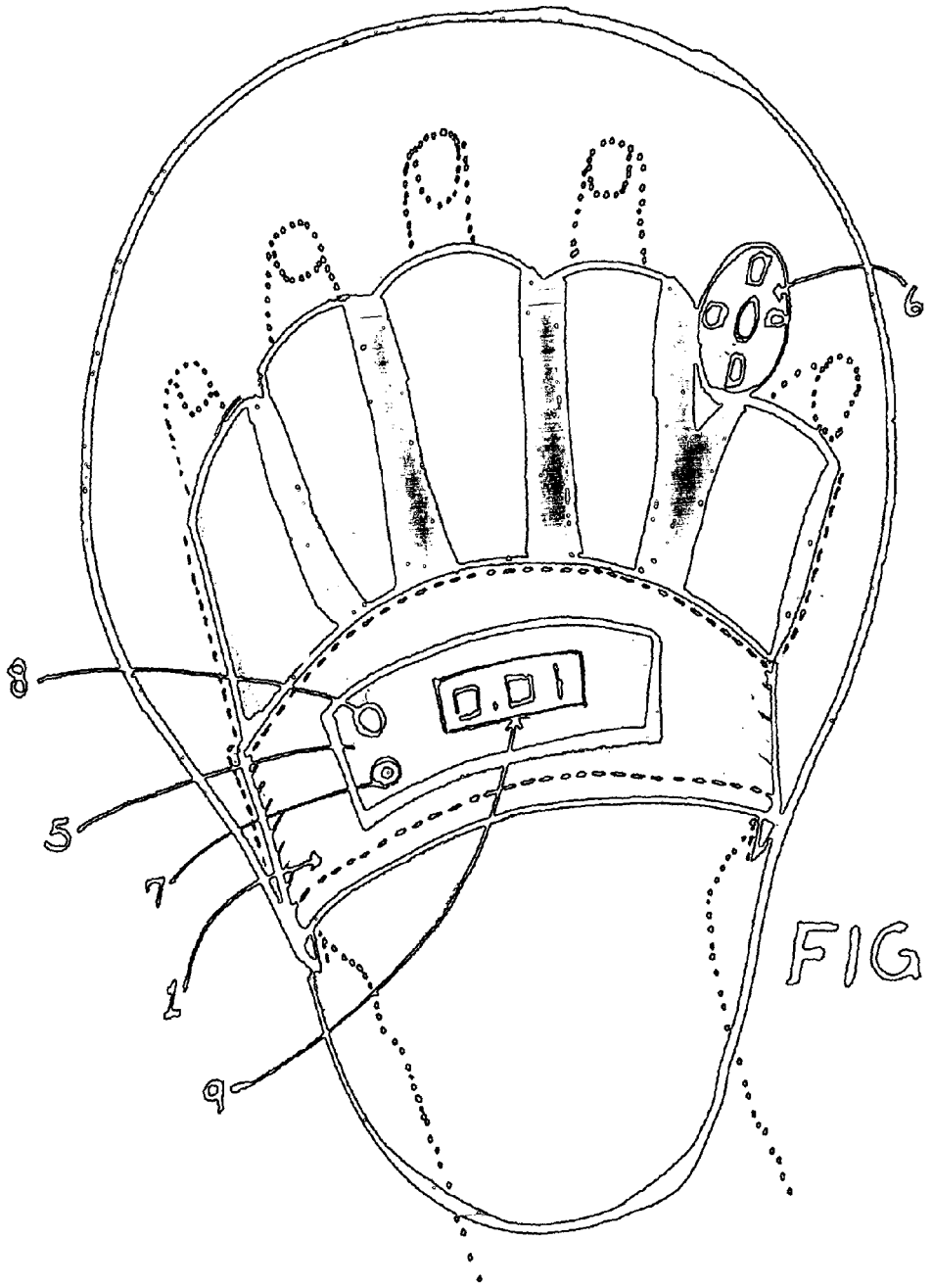
FIG. 2 shows the back hand view of a traditional hand worn strike pad equipped with Reflex Strike Technology.

FIG. 2 illustrates the hand insert area on of the present patent. The view in the illustration is on the opposite side of the striking area. Located on the wrist area of the pad is the PCB enclosure 5 which houses the digital display 9. The trainer-trigger 6, illustrated on the thumb area of the hand insert glove, will display settings and performance on the digital display 9.

Figure 3:
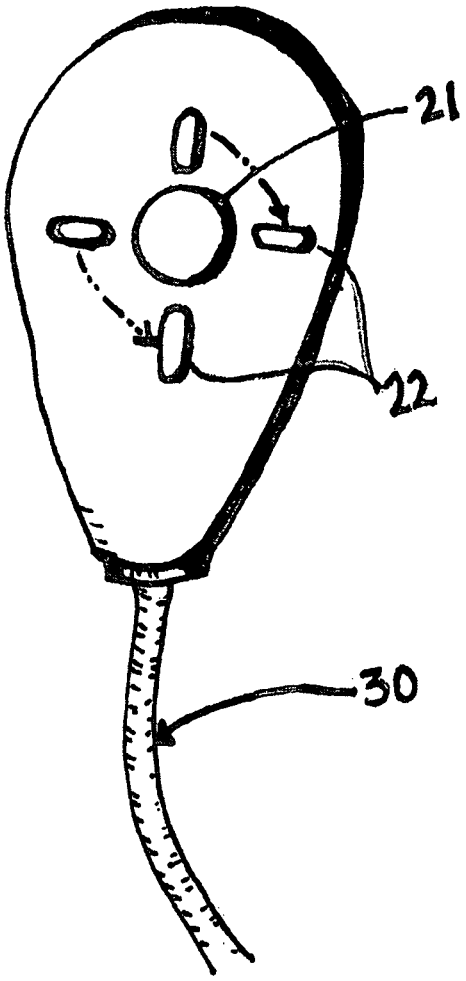
FIG. 3 shows a face view of the thumb trigger buttons.

FIG. 3 shows the exploded view of the suggested thumb trigger 6 configuration. While the configuration is subject to change, the current configuration consists of five buttons. The large button in the middle 21 will activate the light and the other buttons 22 will change the duration of the light as well as toggle through various settings of the pad and display its settings on the number display meter 9. Buttons 21 and 22 are connected to the main PCB 27 by wire 30.

Figure 4:
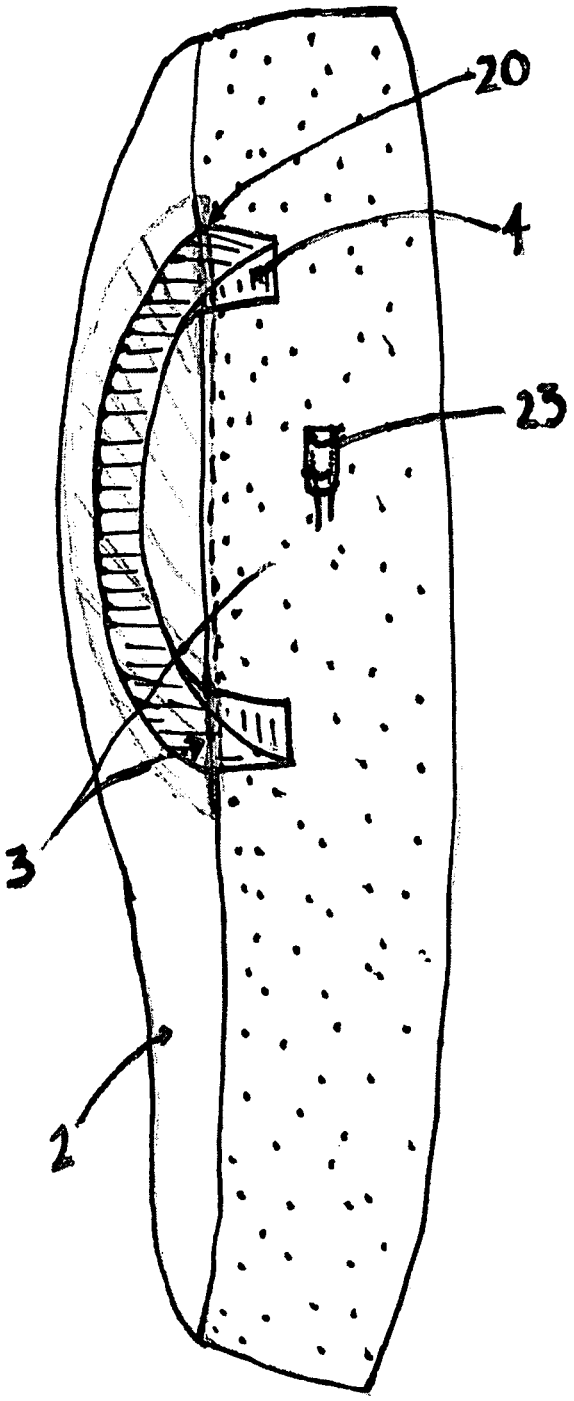
FIG. 4 shows a side view of the padding on a traditional strike pad with trainer triggered lights cut in half down the middle.

FIG. 4 illustrates the striking pad worn on the trainers' hand. The view shows the padding cut in half to expose the process of adding the light to the striking area. The padding is cut the same as the shape of the light 4. In this case, the light 4 is a flat EL light panel circle. At least 1 inch is cut away from the padding 3, leaving a canal of empty space surrounding the center of the padding 3 left on the strike area which prevents the middle of the strike area from collapsing on the lights. Because of the light being pushed into the padding 3 and sealed in with clear vinyl 20, the light remains away from the direct force of strikes.

Figure 7:
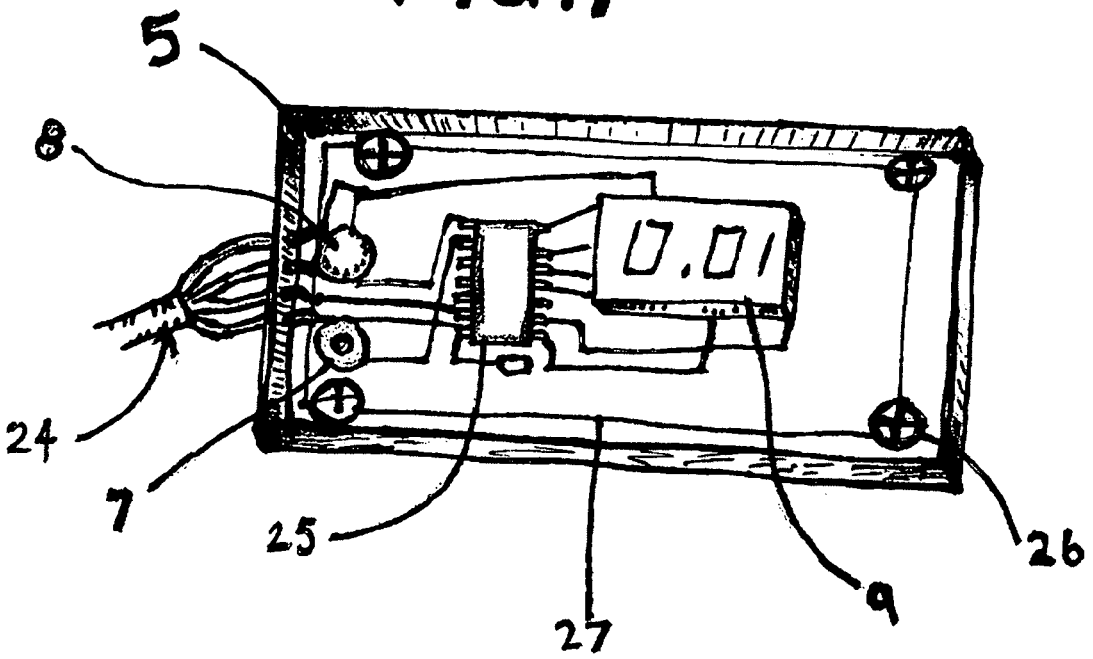
FIG. 7 shows the inside of the enclosure 5 located on the wrist area of the display.

FIG. 7 is connected to the remote components of the system using wires 24 and will enter the padding 3 and connect to light 4, vibration sensor 23, successful strike sound 28 and thumb trigger 6 buttons 21 and 22 using wire 30 of the main PCB 27. This will allow for controlling the settings and activating the lights 10 and 4 from within the glove or hand location of the mitt being held or worn by the trainer. The electronics in disclosed in FIG. 7 apply to all shapes of traditional shaped striking pads worn or held by a trainer.

Enclosure 5 will house the power button 8, the main PCB 27, the microchip 25, the digital display, and the rechargeable female input 7. With the microchip 25, different functions may be programmed which will allow different characteristics of the strike to be measured and displayed instantaneously.

Figure 5:
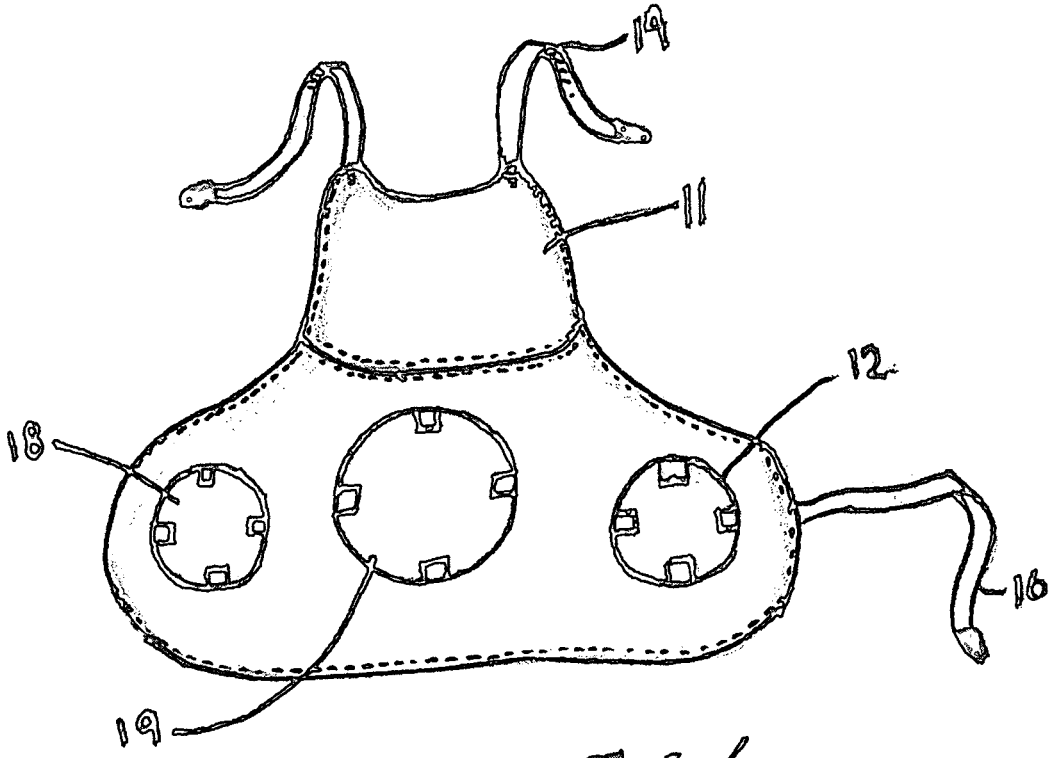
FIG. 5 shows a face view of a traditional worn striking pad equipped with trainer triggered lights.
Figure 6:
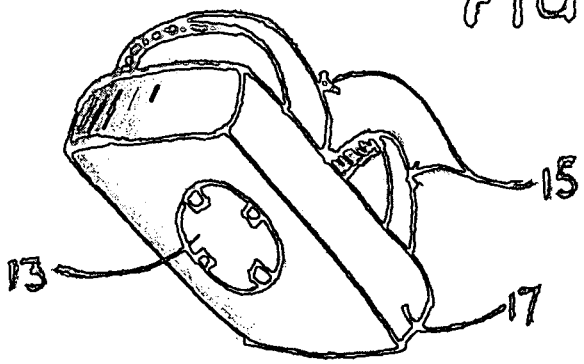
FIG. 6 shows an additional traditional striking pad held by a trainer, primarily for kicking, equipped with trainer triggered lights.

FIG. 5 illustrates other traditional trainer worn or held strike pads. The drawing shows a body protector incorporated with the same technology and methodology for incorporating trainer triggered lights shown in FIGS. 1, 2 and 4. FIG. 6 shows a kicking strike pad held by a trainer incorporated with trainer triggered lights. These are traditional trainer worn or held striking pads equipped with reflex strike technology using the same methods used in FIGS. 1, 2 and 4. While straps 14 and 16 are used to secure the body striking pad onto a trainer, handles 15 allow for the trainer to brace for striking impact. While the shapes of the striking pad are different in shape and function, they pertain to traditional held or worn striking pads. The body-worn striking pad illustration in FIG. 5 shows light 18, 19 and 12 placement, and FIG. 6 shows light 13 placement in accordance to their respective shapes.

In describing the embodiments listed above, it should be noted that improvements are likely to continue in the development improving traditional striking pads worn or held by a trainer. While the present invention currently improves on the positive aspects of previously proven patents, additional changes may be made in its construction, however, using the same goals of maintaining the concept of the invention.

What I claim as my invention is:

1. Striking targets to be held by a trainer, comprising straps mounted to the targets for mounting to hands, Said targets comprising thumb triggered lights, accelerometers, microchips, vibration sensors and digital displays, for allowing said trainer to practice fighting strikes and measure striking effectiveness: power, response time and strike frequency, wherein the response time of said strike starts is activated with the thumb triggered lights and is recorded with the jarring of said vibration sensor by the striking of the targets.

2. The striking targets of claim 1, wherein the lights are added to the padding are visible to the surface of the strike area by a fighter making the strike.

3. The striking targets of claim 1, wherein the duration of the light is adjustable.

4. The striking targets of claim 1, wherein the total strike frequency is counted by the total number of times said vibration sensor has been struck.

* * * * *